US009173488B1

(12) United States Patent
Bello

(10) Patent No.: US 9,173,488 B1
(45) Date of Patent: Nov. 3, 2015

(54) COMBINATION DRAWER ASSEMBLY

(71) Applicant: Thomas J. Bello, Hilo, HI (US)

(72) Inventor: Thomas J. Bello, Hilo, HI (US)

( * ) Notice: Subject to any disclaimer, the term of this patent is extended or adjusted under 35 U.S.C. 154(b) by 0 days.

(21) Appl. No.: 14/101,991

(22) Filed: Dec. 10, 2013

Related U.S. Application Data

(60) Provisional application No. 61/735,107, filed on Dec. 10, 2012.

(51) Int. Cl.
*A47B 88/00* (2006.01)
*A47B 88/08* (2006.01)
*A47B 88/22* (2006.01)

(52) U.S. Cl.
CPC ..... *A47B 88/08* (2013.01); *A47B 88/22* (2013.01)

(58) Field of Classification Search
CPC .... A47B 88/0451; A47B 88/22; A47B 88/04; A47B 2007/20; A47B 2210/0059; A47B 2210/07
USPC ..... 312/330.1, 334.1, 334.7–334.9, 291, 312/301, 334.11, 348.3, 270.1, 270.3; 384/18–20
See application file for complete search history.

(56) References Cited

U.S. PATENT DOCUMENTS

| | | | | | |
|---|---|---|---|---|---|
| 5,993 | A | * | 1/1849 | Knight | 4/602 |
| 128,439 | A | | 6/1872 | Unna | |
| 158,423 | A | * | 1/1875 | Knight | 312/226 |
| 444,151 | A | * | 1/1891 | Hull | 312/290 |
| 1,496,099 | A | * | 6/1924 | O'Connor | 70/86 |
| 3,160,448 | A | * | 12/1964 | Abernathy et al. | 384/23 |
| 3,473,187 | A | * | 10/1969 | Clark et al. | 16/419 |
| 3,797,906 | A | * | 3/1974 | Gutner | 312/334.27 |
| 4,993,786 | A | | 2/1991 | De Giulio | |
| 5,037,165 | A | * | 8/1991 | Rapp et al. | 312/330.1 |
| 5,044,059 | A | | 9/1991 | De Giulio | |
| 5,468,062 | A | * | 11/1995 | Finnegan | 312/301 |
| 5,868,479 | A | * | 2/1999 | Hoffman | 312/334.44 |
| 6,003,202 | A | * | 12/1999 | Dauterive | 16/429 |
| 6,086,176 | A | * | 7/2000 | Aoyama | 312/286 |
| 6,811,232 | B2 | | 11/2004 | Doan et al. | |
| 7,082,783 | B2 | * | 8/2006 | Uihlein et al. | 62/441 |

(Continued)

FOREIGN PATENT DOCUMENTS

| | | | |
|---|---|---|---|
| CH | 309500 | * | 11/1955 |
| DE | 3730342 | * | 3/1989 |
| GB | 751838 | * | 7/1956 |

OTHER PUBLICATIONS

Drawer Connection, Inc. http://www.dcdrawers.com/photo.htm, Jul. 24, 2012.

*Primary Examiner* — Janet M Wilkens
(74) *Attorney, Agent, or Firm* — Robert C. Montgomery; Montgomery Patent & Design

(57) ABSTRACT

A cabinet system modified to accommodate a fully retractable drawer within a drawer comprises a housing having a plurality of conjoined panels to define a first interior cavity and a first set of drawers slidably attached to tracks on the interior surfaces of opposing panels. Each drawer comprises a set of conjoined panels to define a second interior cavity panel, left panel, front panel, rear panel and bottom panel, wherein each panel has an interior surface and an exterior surface. Attached to the interior surfaces of each drawer's opposing panels is a track for slidably mounting a second drawer. When a first drawer is fully extended away from the first interior cavity, the second drawer can remain fully retracted within the first drawer or be fully extended into the first interior cavity.

13 Claims, 4 Drawing Sheets

(56) References Cited

U.S. PATENT DOCUMENTS 7,722,139 B1 * 5/2010 Chen et al. ..... 312/334.7
8,708,435 B2 * 4/2014 Johnson et al. ..... 312/330.1
2005/0017607 A1 * 1/2005 Weinberger ..... 312/215
2013/0169133 A1 * 7/2013 Johnson et al. ..... 312/298

* cited by examiner

COMBINATION DRAWER ASSEMBLY

RELATED APPLICATIONS

The present invention was first described in and claims the benefit of U.S. Provisional Application No. 61/735,107, filed Dec. 10, 2012, the entire disclosures of which are incorporated herein by reference.

FIELD OF THE INVENTION

The present invention relates to a drawer assembly and more specifically to a drawer assembly with a secondary drawer fully retractable and deployable relative to a main drawer.

BACKGROUND OF THE INVENTION

It is common to store a motley of items within drawers of cabinetry. Unfortunately, the diverse nature of these items leads to contrasting space and height requirements that would optimally contain such items in one location. Consequently, items are haphazardly fitted into the drawer space, leading to disorganization and overflowing. Surprisingly, the tidiest drawers often lose serviceability because items are placed neatly in one row on the bottom of the drawer, resulting in much of the upper space of the drawer unoccupied. It would be a benefit to exploit the entire storage space of an interior of a cabinet with the use of a secondary drawer housed within the main drawer. This would enable selecting items within the secondary drawer while maintaining the position of the other items in the main drawer. The development of the present invention fulfills this need.

The assembly comprises a dual drawer arrangement that may be retrofitted into an existing cabinet. A main drawer houses a secondary drawer, where the secondary drawer slides from within the main drawer. When fully retracted, the secondary drawer acts as a shelf, or a second storage compartment of the main drawer. When extended, the secondary drawer reveals the contents of the main drawer. The dual drawer arrangement is retrofitted into any cabinet interior via a track system. The use of the drawers enables segmentation of items and capitalization of the entire storage space within a cabinet.

Prior art in this field consists of dual drawer assemblies that incorporate a secondary drawer slidably engaged with an interior of a main drawer, but nothing of the prior art enables retrofitting an interior cabinet with a dual drawer assembly. These prior art dual drawer assemblies are constructed for specific use with specific cabinetry. Other prior art drawer assemblies consist of retrofitting a sliding tray within a main drawer.

It is an objective of this invention to provide a dual drawer assembly to be retrofitted into virtually any cabinet opening.

It is a further objective of this invention to not only enable full use of the entire interior storage space of the cabinet by providing a secondary drawer that slides from within a main drawer to reveal the contents of the main drawer, but also enable segmentation and storage within the secondary drawer as well.

It is a further objective of this invention to provide a secondary drawer that either covers a partial sectional opening of the main drawer or an entire sectional opening.

A benefit of this invention is to provide a track system to prevent inadvertent removal of the main drawer from the cabinet, or the secondary drawer from the main drawer, when operating the invention.

An additional benefit of this invention is to provide a digit-operating means to extend and retract the secondary drawer.

SUMMARY OF THE INVENTION

The assembly comprises a retrofitting dual drawer arrangement. The drawer arrangement comprises a main drawer and a secondary drawer, where the secondary drawer is configured to fit inside the main drawer. A first track system is affixed to an interior storage space of an existing cabinet. A second track system is affixed to an exterior of the main drawer. The dual drawer arrangement is inserted into the interior storage space of an existing cabinet such that the first track and second track engage each other. The engagement of the first and second tracks enable sliding motion of the dual drawer arrangement with respect to the interior space of the cabinet such that the dual drawer arrangement extends from the interior space and retracts back into the interior space.

A third track system is affixed to an interior of the main drawer. A fourth track system is affixed to an exterior of the secondary drawer. The secondary drawer is inserted into the main drawer such that the third track and fourth track engage each other. The engagement of the third and fourth tracks enables sliding motion of the secondary drawer with respect to the main drawer. When the main drawer is in an extended position, the secondary drawer can be extended from the interior of the main drawer, thereby retracting into the interior of the cabinet. Conversely, the secondary drawer can be retracted into the interior of the main drawer, thereby extending from the interior of the cabinet.

The dual drawer arrangement is such that the secondary drawer provides a slidable partitioning of the main drawer. When in a fully retracted state, with respect to the main drawer, the secondary drawer may be configured to cover the entire sectional opening of the main drawer, thereby acting as a segmentation. Alternatively, the secondary drawer may be configured to cover only a partial sectional opening, thereby acting as a shelved partition. Furthermore, the depth of the secondary drawer, and placement thereof within the main drawer, may be such as to render the secondary drawer a mere tray or as the chief storage compartment of the assembly.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
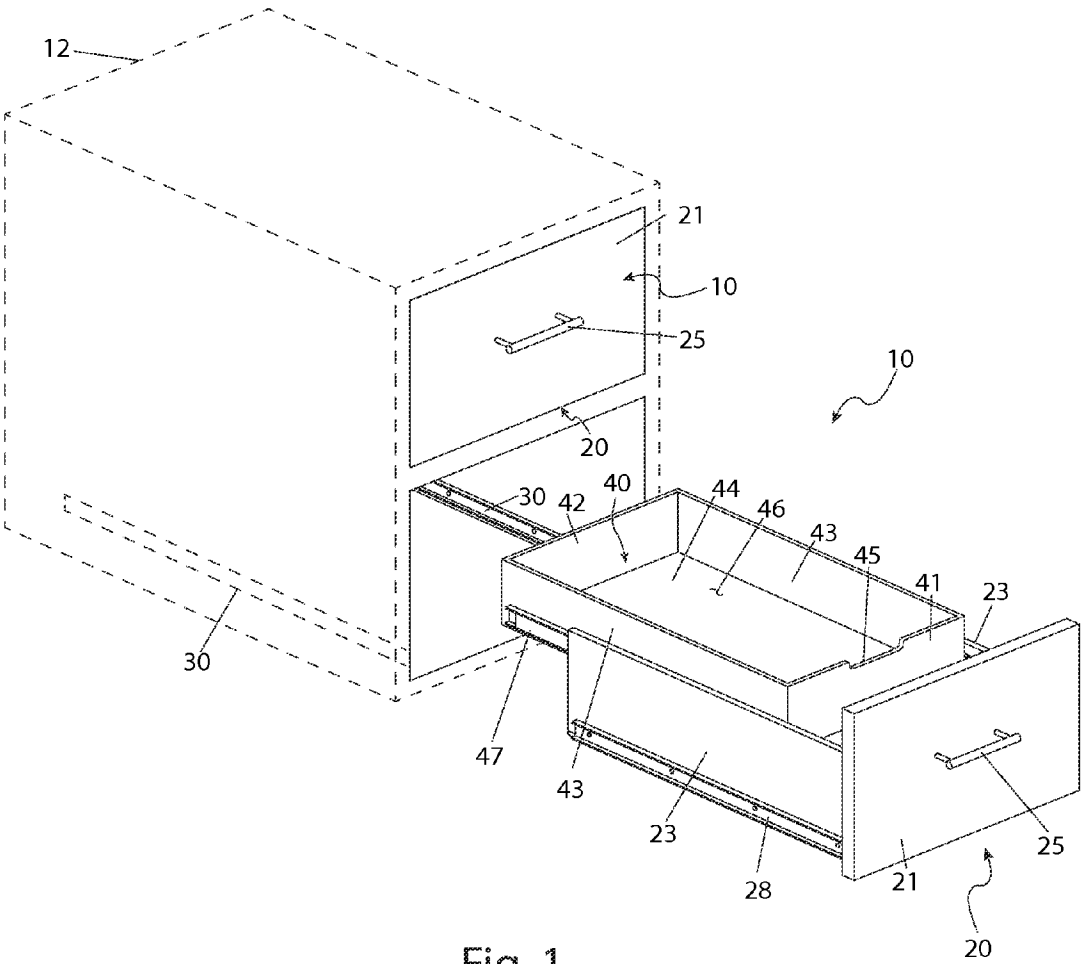
FIG. 1 is an environmental view of a combination drawer assembly 10, according to a preferred embodiment of the present invention.

10 combination drawer assembly
12 cabinet
20 main drawer
21 main drawer front panel
22 main drawer rear panel
23 main drawer side panel
24 main drawer bottom panel
25 handle
26 main drawer interior cavity
27 main drawer interior track
28 main drawer exterior track
30 cabinet track
40 secondary drawer
41 secondary drawer front panel
42 secondary drawer rear panel
43 secondary drawer side panel
44 secondary drawer bottom panel
45 notch
46 secondary drawer interior cavity
47 secondary drawer track

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a combination drawer assembly (herein described as the "assembly") 10, which provides a unique means for maximizing storage space.

Referring now to FIG. 1, an environmental view of the assembly 10, according to the preferred embodiment of the present invention, is disclosed. The assembly 10 comprises a main drawer 20 and a secondary drawer 40 which are utilized in combination as a slidably nesting configuration to maximize storage space. The assembly 10 is envisioned to be mounted within an existing cabinet 12 or other similar storage area via a cabinet mounted track 30 (see herein below). The assembly 10 is also envisioned to be manufactured in various sizes such as sixteen to thirty-two inches (16-32 in.) in width and twenty-two inches (22 in.) in depth in order to fit the dimensions of the desired cabinet 12. The assembly is fabricated from materials such as, but not limited to: wood, plastic, metal, or the like and are manufactured in various colors and patterns to correspond to the décor.

Figure 2:
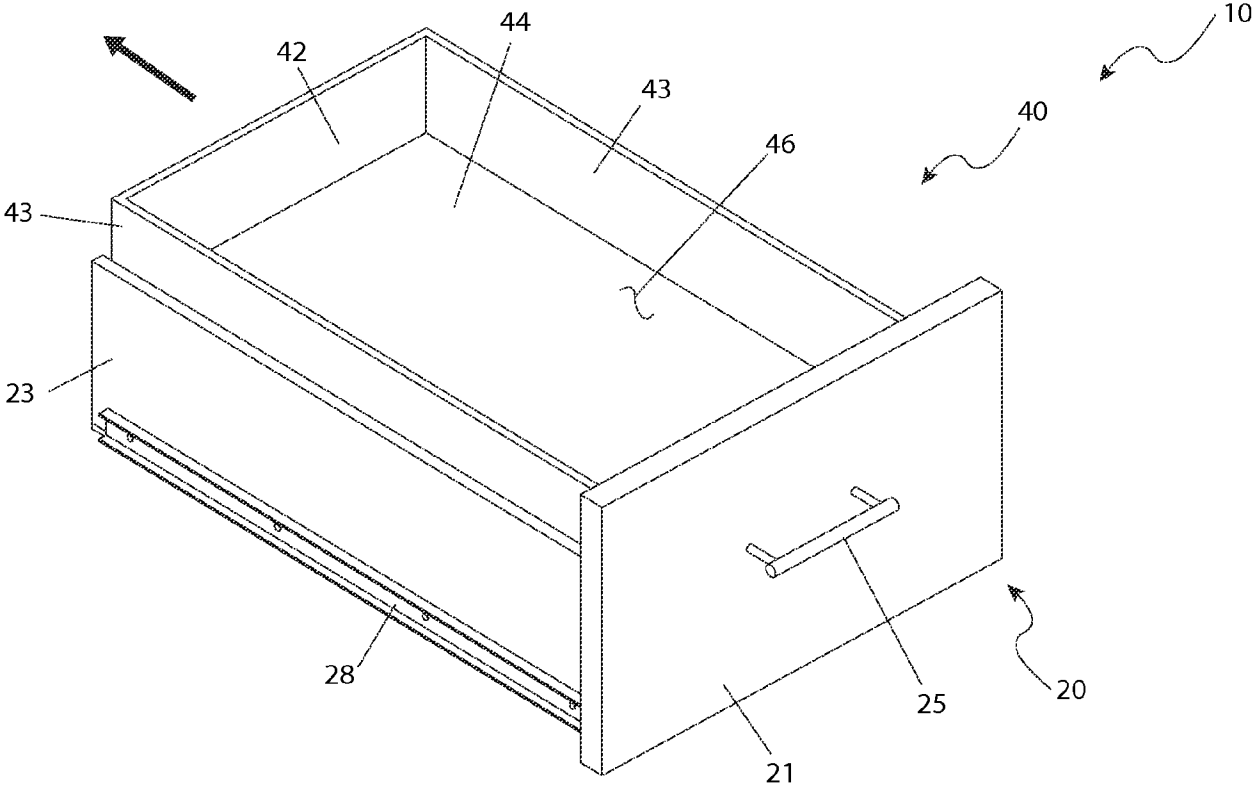
FIG. 2 is a perspective view of the combination drawer assembly 10, according to a preferred embodiment of the present invention.
Figure 3:
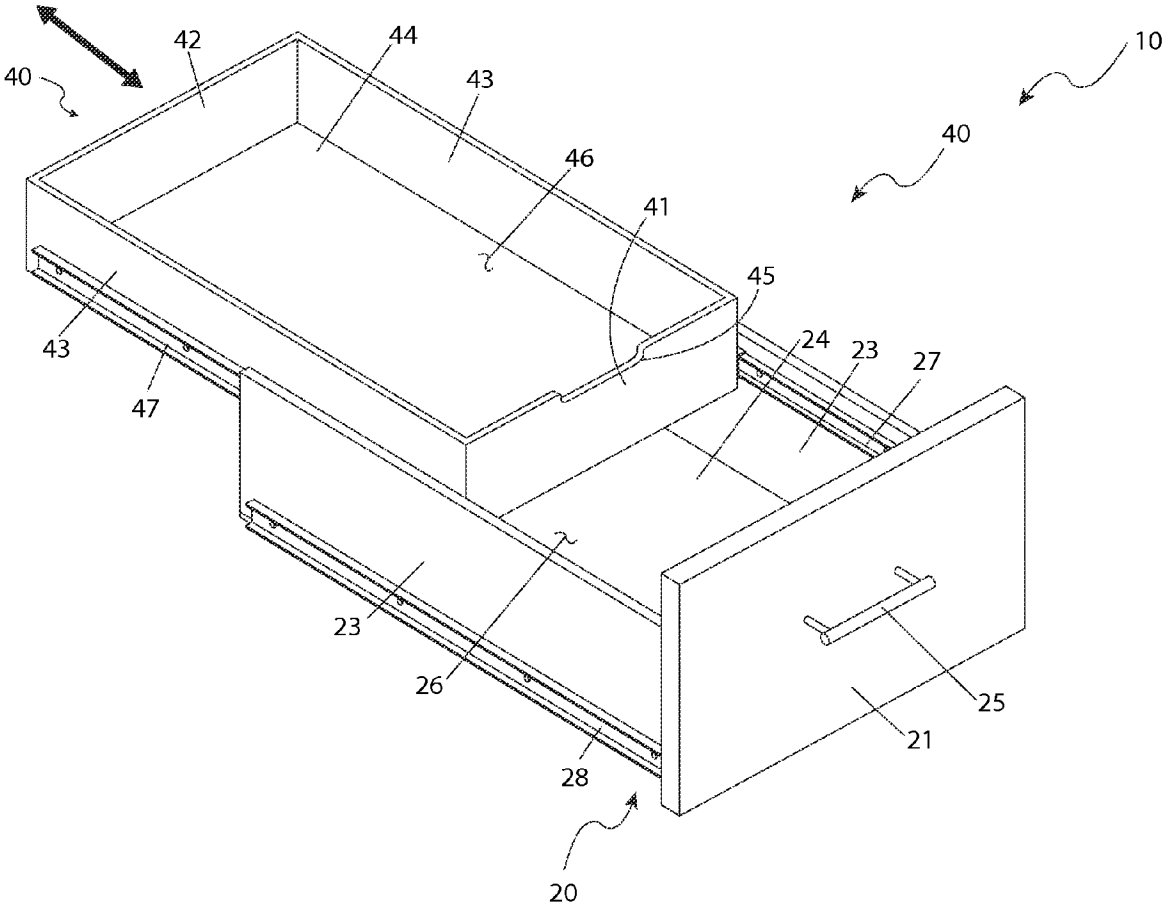
FIG. 3 is another perspective view of the combination drawer assembly 10, according to a preferred embodiment of the present invention; and, FIG. 4 is yet another perspective view of the combination drawer assembly 10, according to a preferred embodiment of the present invention.
Figure 4:
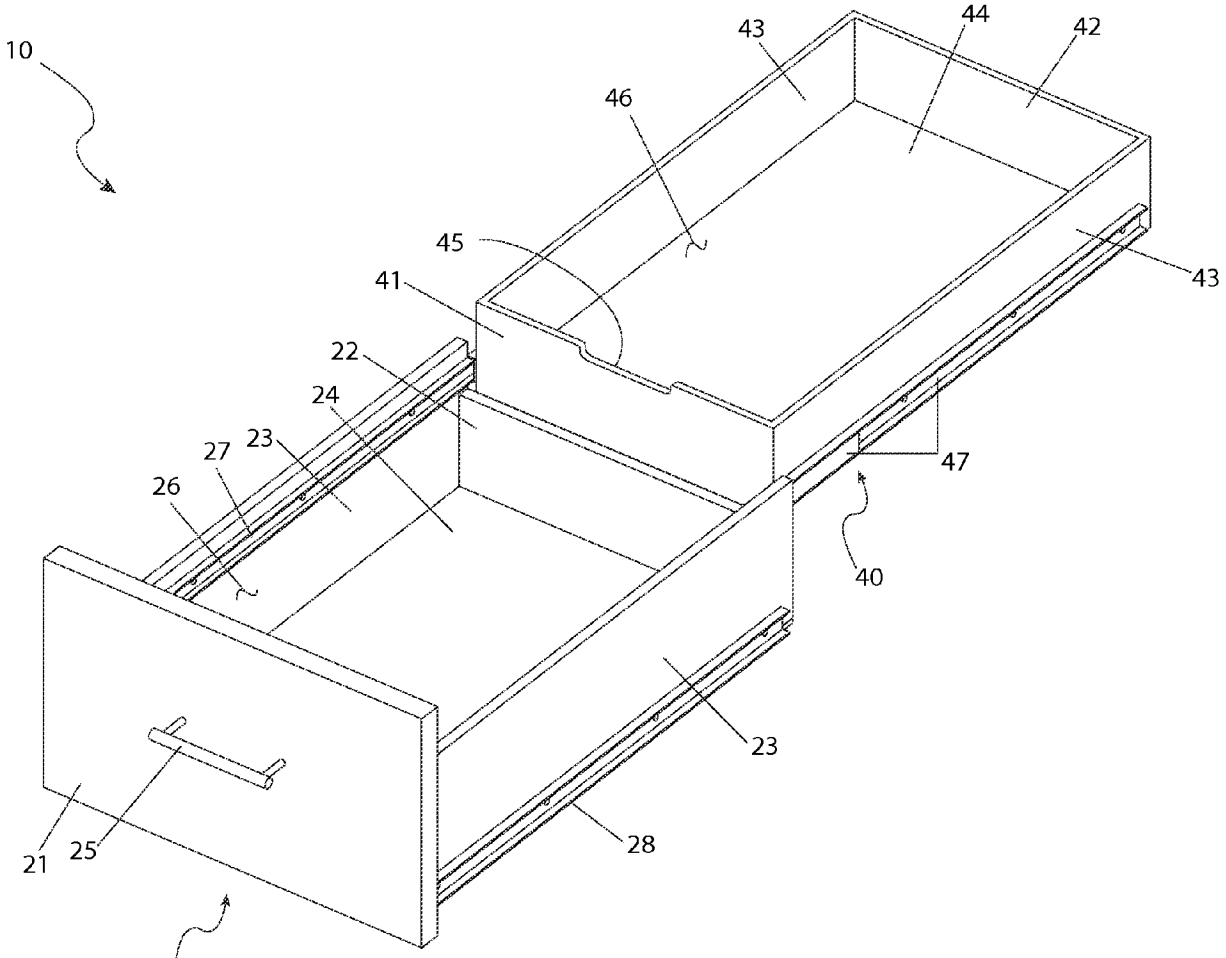

Referring now to FIGS. 2 through 4, various perspective views of the assembly 10 depicting various states, according to the preferred embodiment of the present invention, are disclosed. FIG. 2 depicts the assembly 10 in either a fully retracted state (positioned within the cabinet 12) or in a fully extended state (both the main drawer 20 and secondary drawer 40 are extended out from the cabinet 12). FIG. 3 depicts the assembly 10 in a partially extended state (the main drawer 20 is fully extended out from the cabinet 12, and the secondary drawer 40 is partially extended away from the cabinet 12). FIG. 4 depicts the main drawer 20 in a fully extended state (away from the cabinet 12), and the secondary drawer 40 in a fully retracted state (within the cabinet 12).

The main drawer 20 is generally rectangular, and comprises a main drawer front panel 21, a main drawer rear panel 22, a pair of opposing main drawer side panels 23, and a main drawer bottom panel 24. The main drawer panels 21, 22, 23, 24 create a main drawer interior cavity 26, which is utilized for storage of desired items, foodstuffs, or the like. The main drawer interior cavity 26 also enables the secondary drawer 40 to attach. The secondary drawer 40 is generally rectangular, and comprises a secondary drawer front panel 41, a secondary drawer rear panel 42, a pair of opposing secondary drawer side panels 43, and a secondary drawer bottom panel 44. The secondary drawer panels 41, 42, 43, 44 create a secondary drawer interior cavity 66, which is utilized for additional storage of desired items.

The main drawer front panel 21 includes an intermediately positioned handle 25 which is utilized to open or close the main drawer 20. The handle 25 enables a user to grasp and pull the main drawer 20 open or closed in a preferably ergonomic style to promote comfort of use. The handle 25 is preferably a "U"-shaped member attached to the main drawer front panel 21 via mechanical fasteners, yet it is known that other shapes and fastening devices may be utilized without limiting the scope of the invention.

The secondary drawer front panel 41 includes an integral notch 45, thereby providing a digit-operated means of extending or retracting the secondary drawer 40. The notch 45 is depicted as being an indentation along an intermediated edge of the secondary drawer front panel 41, yet it is known that other positions may be utilized without limiting the scope of the invention.

Each main drawer side panels 23 comprise a main drawer interior track 27, thereby providing an operating means to extend or retract the secondary drawer 40. Interior perimeter edges of each main drawer side panel 23 comprise a main drawer interior track 27, which enables attachment of the secondary drawer 40. Each exterior surface of the secondary drawer side panels 43 comprise a secondary drawer track 47, which engage the main drawer interior track 27, thereby enabling the secondary drawer 40 to be extended or retracted from the main drawer 20. The secondary drawer 40, in a fully extended state (see FIG. 2), will obstruct the main drawer interior cavity 26 and expose the secondary drawer interior cavity 46. Alternatively, the secondary drawer 40 may be configured such that, when fully extended, it partially obstructs the main drawer interior cavity 26. The secondary drawer 40, in a fully retracted state (see FIG. 4), will allow access to the main drawer interior cavity 26 and obstruct the secondary drawer interior cavity 46 because the secondary drawer 40 will be positioned within the cabinet 12. Alternatively, the secondary drawer 40 may be configured such that it will allow access to the main drawer interior cavity 26 and obstruct the second drawer interior cavity 46 even if only partially retracted. The main drawer interior tracks 27 and the secondary drawer tracks 47 attached to the main drawer 20 and secondary drawer 40, respectively, via mechanical fasteners or integral molding. The main drawer interior tracks 27 and the secondary drawer tracks 47 are envisioned to be a common draw slide systems which can handle the weight of the drawers 20, 40 and prohibit the drawers 20, 40 from being accidentally removed from the cabinet 12.

Each main drawer side panels 23 also comprise a main drawer exterior track 27, thereby providing an operating means to the main drawer 20. Each exterior surface of the main drawer 20 comprises a main drawer exterior track 28, which engages a cabinet mounted track 30. The cabinet mounted track 30 is mounted within an inner cabinet 12 side surfaces to enable the main drawer 20 to extend or retract from said cabinet 12. The main drawer exterior tracks 28 are attached to a lower exterior perimeter edge of each main drawer side panel 23 via common fastening means or integral molding. The main drawer exterior tracks 28 and the cabinet mounted tracks 30 are envisioned to be a similar sliding system to the abovementioned main drawer interior tracks 27 and the secondary drawer tracks 28.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the assembly 10, it would be installed as indicated in FIG. 1.

The method of utilizing the assembly 10 may be achieved by performing the following steps: acquiring the assembly 10; mounting the cabinet mounted tracks 30 onto the interior surface of the cabinet 12; engaging the main drawer interior tracks 27 with the secondary drawer tracks 47 and enabling the secondary drawer 40 to extend or retract from the main drawer 20; engaging the main drawer exterior tracks 28 with the cabinet mounted tracks 30 and enabling the main drawer 20 to extend and retract from the cabinet 12; placing items with in the cavities 26, 46 as desired; repeating as desired; and, utilizing the assembly to maximize storage.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A combination drawer assembly, comprising:

a cabinet having an interior with a cabinet track attached to a cabinet sidewall;

a main drawer comprising a main front panel, a main rear panel, opposing pair of main side panels, and a main bottom panel, said main drawer defining a main interior cavity;

a secondary drawer comprising a secondary front panel, a secondary rear panel, opposing pair of secondary side panels, and a secondary bottom panel, said secondary drawer defines a secondary interior cavity;

a main drawer exterior track connected to said main side panels and slidably coupling said main drawer to said cabinet track;

a main drawer interior track connected to said main side panels;

a secondary drawer track connected to said secondary side panels for slidably coupling said secondary drawer to said main drawer interior track;

wherein said main drawer extends from and retracts into said interior of said cabinet by traverse motion along said cabinet track;

wherein said secondary drawer extends from and retracts into said interior of said cabinet independent of said main drawer by traverse motion along said main drawer interior track when said main drawer is fully extended; and, wherein said secondary drawer is positioned above said main drawer interior cavity and is suitably dimensioned to align with and fully cover said main interior cavity when said secondary drawer is fully extended and said secondary front panel abuts said main front panel.

2. The assembly of claim 1, wherein:

said cabinet track comprises:

an opposed set of cabinet track rails, wherein one cabinet track rail of said set of cabinet track rails is attached to each interior side of opposing interior sides of said cabinet defining said interior;

said main drawer exterior track comprises:

an opposed set of main drawer exterior track rails operatively coupled to said cabinet track rails, one main drawer exterior track rail of said set of main drawer exterior track rails is attached to an exterior of each main side panel of said pair of main side panels;

said main drawer interior track comprises:

an opposed set of main drawer interior track rails, wherein one main drawer interior track rail of said set of main drawer interior track rails is attached to an interior of said each main opposing side panel;

said secondary drawer track comprises:

an opposed set of secondary drawer track rails operatively coupled to said main drawer interior track rails, wherein one secondary drawer track rail of said set of secondary drawer track rails is attached to an exterior of each secondary side panel of said pair of secondary side panels;

said set of main drawer exterior track rails and set of cabinet track rails are configured to slidably engage each other so that said set of main drawer exterior track rails linearly traverses a length of said cabinet track rails to extend and retract said main drawer from said cabinet; and, said set of main drawer interior track rails and set of secondary drawer track rails are configured to slidably engage each other so that said secondary drawer track rails linearly traverses a length of said main drawer interior track rails to extend and retract said secondary drawer from said cabinet when said main drawer is extended.

3. The assembly recited in claim 2, wherein said main drawer is substantially rectangular.

4. The assembly recited in claim 2, wherein said secondary drawer is substantially rectangular.

5. The assembly recited in claim 2, where said secondary front panel is provided with a notch formed within a portion thereof.

6. The assembly recited in claim 5, wherein said notch is configured to receive at least one finger and provide added dexterity to operate said assembly.

7. The assembly recited in claim 2, further comprising a handle affixed to an outer surface of said main front panel.

8. The assembly recited in claim 7, wherein said handle is generally U shaped.

9. The assembly recited in claim 7, wherein said handle is metal.

10. The assembly recited in claim 2, wherein said main drawer is at least partially made of wood.

11. The assembly recited in claim 2, wherein said secondary drawer is at least partially made of wood.

12. The assembly recited in claim 2, wherein said main drawer is at least partially made of plastic.

13. The assembly recited in claim 2, wherein said secondary drawer is at least partially made of plastic.

* * * * *